United States Patent [19]

Stoeffler

[11] 3,942,561

[45] Mar. 9, 1976

[54] APPARATUS FOR FILLING CONTAINERS WITH DIFFICULTLY-FLOWABLE MATERIAL

[75] Inventor: Bernhard Arnold Stoeffler, Gaertringen, Germany

[73] Assignee: Vulcan-Werk Wilhelm Diebold, Germany

[22] Filed: Mar. 11, 1974

[21] Appl. No.: 449,714

[30] Foreign Application Priority Data

Mar. 15, 1973 Germany ..... 7309780[U]
Mar. 31, 1973 Germany ..... 7312224[U]

[52] U.S. Cl. ..... 141/67; 141/376; 141/378; 302/59

[51] Int. Cl.[2] ..... B65B 1/16

[58] Field of Search ..... 141/4, 5, 65, 67, 83, 94, 141/231, 286, 367, 378, 383, 25, 275, 368, 369, 376, 378, 375; 302/59

[56] References Cited

UNITED STATES PATENTS

| | | | |
|---|---|---|---|
| 931,297 | 8/1909 | Handy et al. | 141/275 X |
| 2,292,754 | 8/1942 | Gladfelter | 141/367 |
| 3,219,071 | 11/1965 | Ferster | 141/94 |
| 3,580,645 | 5/1971 | Hagenah | 302/59 |
| 3,720,241 | 3/1973 | Bryant et al. | 141/25 |

*Primary Examiner*—Richard E. Aegerter
*Assistant Examiner*—Frederick R. Schmidt

[57] ABSTRACT

Apparatus for filling containers with difficultly-flowable material, comprising a separator including a filter, a funnel-shaped outlet, and a dust-free butterfly valve for controlling flow of powder through said outlet; and a suction device for conveying said powder by suction to said separator; said outlet adapted to be connected to the container to be filled; said separator being operable to filter powder from the air conveying said powder into the separator and allowing the separated powder to fall into said funnel-shaped outlet. The invention is especially designed for emptying and filling fire-extinguishers.

8 Claims, 8 Drawing Figures

Fig. 7
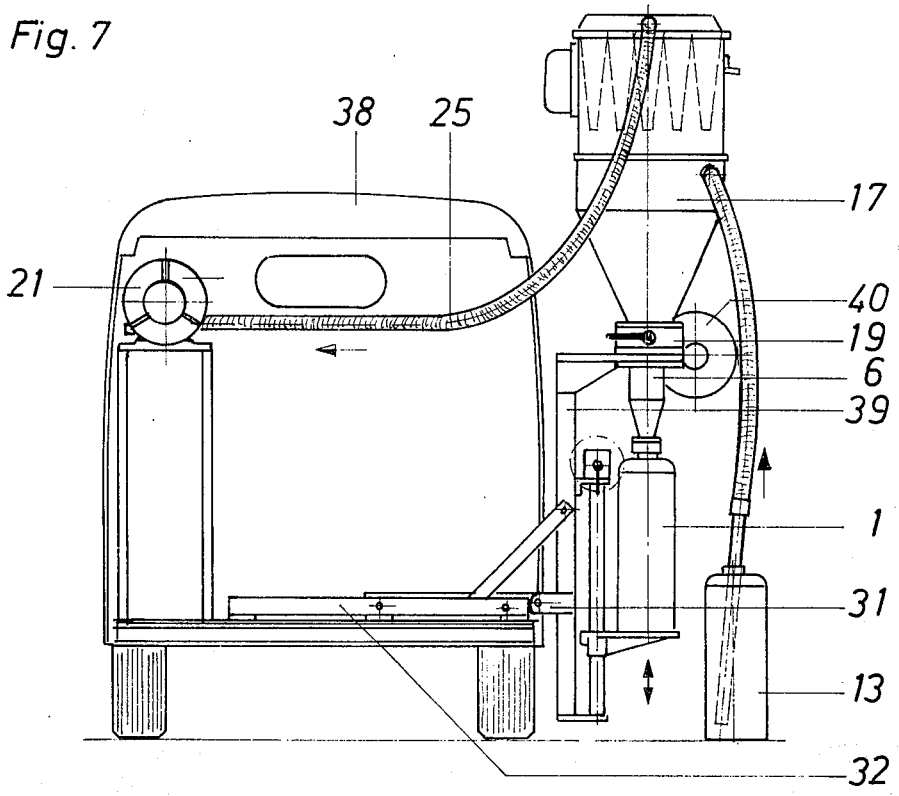
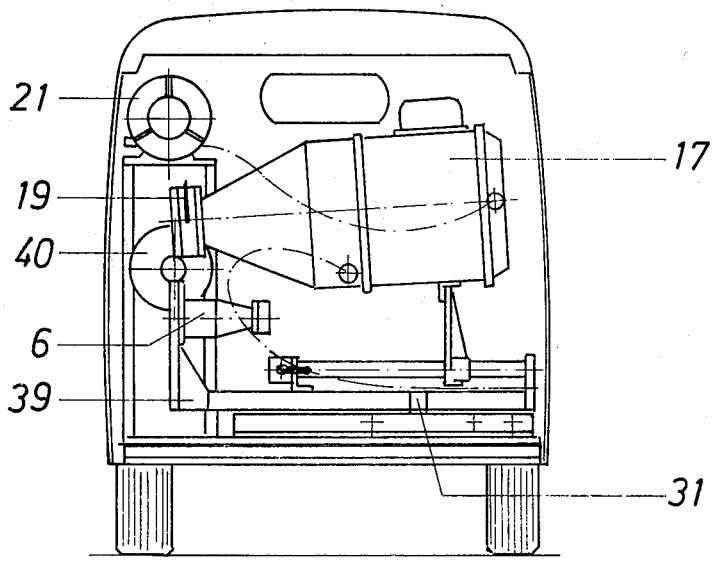
Fig. 8

APPARATUS FOR FILLING CONTAINERS WITH DIFFICULTLY-FLOWABLE MATERIAL

The present invention relates to a device for filling a container with a difficultly-flowable powder material.

As is well known, fire extinguishers and other devices are based on the use of difficultly-flowable powder material, and it is difficult to fill such containers due to clumping of the powder on the one hand and/or increasing in volume and dusting on the other hand.

Known devices rely on suction to draw the powder into the container, but have several disadvantages. For example:

1. If the powder drawn into the container is allowed to free-fall, and no dust-proof connection is provided between the filling funnel and the container to be filled, then there is the problem of dusting and a disadvantageous mixing of the powder with ambient air, thereby loosening the powder and requiring a larger space to hold it.

2. When small filling openings are used, the powders tend to form bridges, thereby causing clogging.

3. If a worm conveyor is used, the compacted powder loosens up during the free-fall and impact therefrom.

4. If a strong vacuum is used, a double pipe is necessary, thereby increasing the complexity of the apparatus.

The present invention overcomes these problems by providing a closed system in which the powder is conveyed via the shortest path directly into the container to be filled.

Thus, the present invention provides apparatus for filling containers with difficultly-flowable material, comprising separator means including a filter, a funnel-shaped outlet means, and a dust-proof butterfly valve for controlling flow of powder through said outlet means; suction means for conveying said powder by suction to said separator means; and means for connecting said outlet means to the container to be filled; said separator means being operable to filter powder from the air conveying said powder into the separator means and allowing the separated powder to fall into said funnel-shaped outlet means.

The apparatus is used as follows

If the powder is only taken out of a container for the purpose of checking and is filled into another container, the container which is to be emptied is clamped in a vise in order to have a firmer stand and to enable the loosening of the sealing cap of the container with a wrench and to unscrew the former.

Thereafter, the suction apparatus is switched on and a suction pipe is inserted into the container, and thus the powder is sucked up. According to the invention, a strainer is arranged at the end of the suction pipe, which prevents impurities or powder lumps from getting into the separator. The strainer can be cleaned by reversing the suction apparatus, thus causing the particles lodged on the strainer to drop off. The powder is then conveyed into the separator. Therein the air and powder are separated. The powder flows by way of the filling funnel into the container which has to be filled. The air returns through the filter to the suction apparatus. The vacuum which is developed in the separator is transmitted into the container to be filled, which causes the powder to flow even through small filling openings and avoids clogging by bridge forming, or the like.

To the extent necessary to have the container attached in a gasproof manner to the filling funnel, a clamping fixture is used, which is designed in such manner that containers of the most different sizes with filling openings of various sizes can be quickly and simply clamped. To this end, an elevator platform is arranged which can be moved upwards and downwards by a crank-drive. A chucking fixture for the container enables fast adjusting to every possible diameter of container. A universal flange is provided against which the elevator platform presses the inserted container, and the flange has a wide, soft rubber gasket face so that all possibly occurring filling openings may be sealed. This universal flange furthermore has a passage bore which will fit in with the smallest filling opening of the container to be filled.

In order to attain the best possible filling rate, it is essential that the flow of the powder can be observed at the narrowest point, that is at the outlet of the filling funnel. Therefore, the filling funnel is made of transparent material according to the invention, thereby assuming at the same time the function of a flow control.

When the air and powder are separated in the separator, powder may remain adhering to the filter faces. They may be cleaned by counterblowing after the filling process. To this extent the direction of rotation of the suction apparatus is reversed and air is pressed into the filter pockets in the opposite direction of the suction.

Furthermore, a vibrator device may be additionally attached to the separator according to the invention, and it is arranged in such manner that the vibration acts on both the filter and on the wall of the funnel of the separator, so that the powder which remains in the inner space of the separator will be entirely removed. By this arrangement it is possible to fill the most different powders, one after the other, without mixing of these powders taking place.

According to the invention, a hand-operated butterfly valve is also arranged between the separator and the filling funnel. This valve is closed when the powder flowing into the separator is stored. After the hand valve is opened, the powder which has been stored in the separator may flow into the container. If the suction is used for an auxiliary action, no negative pressure will occur in the container to be filled, so that the powder flows better.

In order to also fill larger containers that do not fit into the clamping fixture, the separator including the filling funnel can be movably arranged on a sliding plate so that it is possible to move it directly over the filling opening of the container which has to be filled.

To facilitate the filling of a series of identical containers, a scale may be used. In that case, a solid, airproof connecting hose is needed between the filling funnel and the container to be filled. This hose extends in a slightly inclined way between the filling funnel and the container so that its influence on the weighing accuracy is kept as small as possible. The weight of this connecting hose must be taken into consideration at the adjustment of the tare.

The apparatus may also be constructed as a movable device. In that case, the support of the apparatus is made foldable and the support post has a tilting bearing so that the entire device can be folded up and can be moved into a truck. The suction apparatus is not fastened on the support post, but is installed separately in the truck. Since the suction hose is flexible, such an arrangement is feasible.

For filling large powder drums, the separator including the hand valve, can be taken off and may be directly suspended above the filling opening of the drum which has to be filled.

BRIEF DESCRIPTION OF THE DRAWING

FIG. 7 shows the filling apparatus arranged for being installed in a truck;

FIG. 8 shows the filling apparatus shown in FIG. 7, in the folded-up state and being packed in the truck.

DESCRIPTION OF THE PREFERRED EMBODIMENT

Figure 1:
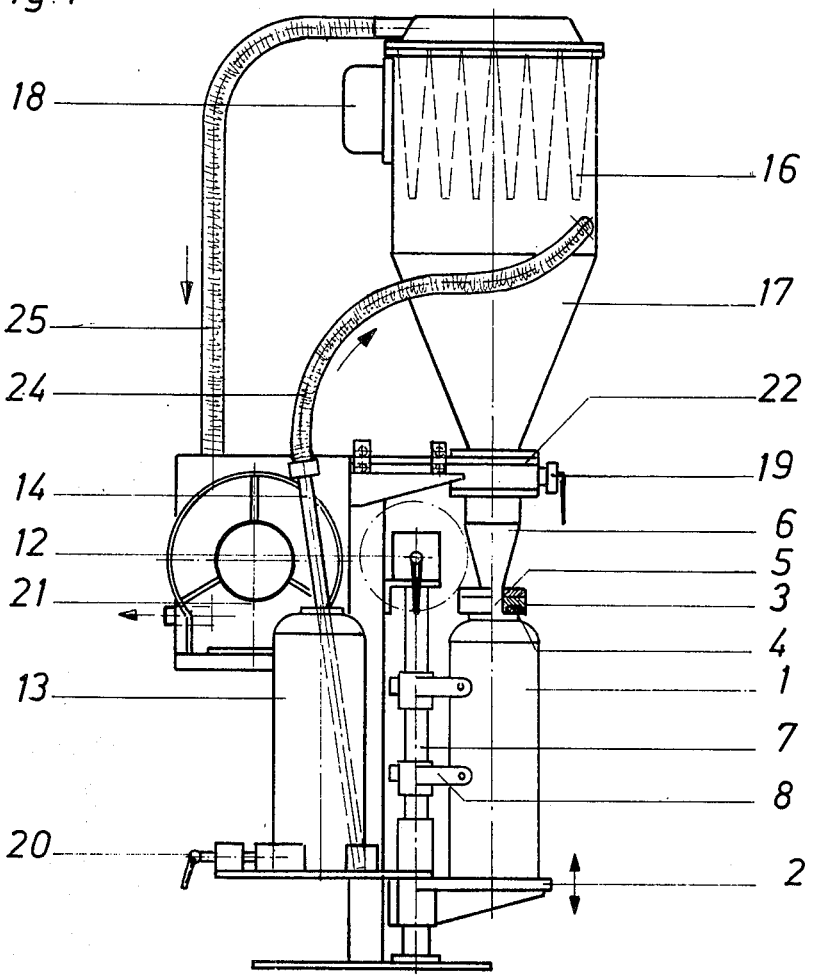
FIG. 1 shows the complete filling apparatus.

FIG. 1 shows a complete filling apparatus having a funnel-shaped separator 17, a suction pipe 14, a suction hose 24, a suction duct 25 with the suction apparatus 21, and the filling funnel 6 with the butterfly valve 19 and the universal flange 3. Powder is to be taken from container 13, which is securely held by vise or clamp 20, and conveyed into container 1. In order to empty the container 13, the latter is clamped in the vise 20 and the powder is conveyed by way of suction pipe 14 through the strainer 15 and suction hose 24 into separator 17. In separator 17 the conveying air and the powder are separated. The powder flows from separator 17 through butterfly valve 19 into filling funnel 6 and from there into the container 1 which has to be filled. The air passes through the filter 16 and suction duct 25 to suction apparatus 21 and from there out into the ambient atmosphere. Universal flange 3 is provided with a soft rubber sealing gasket 4 surrounding the bore 5 of flange 3. Flange 3 thus effects sealing engagement with container 13.

When container 13 is entirely emptied by the vacuum, suction apparatus 21 is switched off. The latter is automatically switched into reverse and conveys air back through suction duct 25 into filter 16. This is thus inflated and the adhering powder drops off. At the same time the vibrator 18 is switched on, which vibrates both filter 16 and the cone-shaped wall of separator 17, so that the remaining fine particles of the powder are loosened and flow through filling funnel 6 into the container 1 which has to be filled. It is possible to observe, via filling funnel 6 which consists of transparent material, as to how the powder flows entirely into container 1 which has to be filled. When the filling process has been terminated, the elevator platform 2 is moved downward by the crank drive 12, and filled container 1 is removed.

Figure 2:
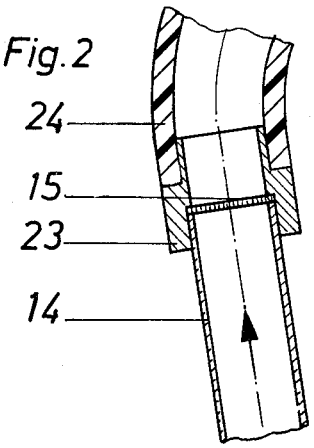
FIG. 2 shows a strainer built in the connecting pipe.

Strainer 15 is inserted in connector 23, as shown in FIG. 2, which connects suction pipe 14 with suction hose 22.

Strainer 15 prevents impurities or lumped powder from getting into separator 17. When strainer 15 gets clogged, it will be immediately noticeable from the output of the suction. Strainer 15 can be very rapidly cleaned by removing suction pipe 14; however, in many cases, the strainer 15 can be cleaned merely by switching off the vacuum and allowing the clogged material to fall off.

Figure 3:
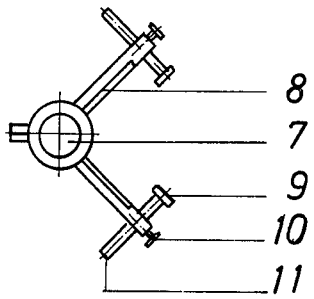
FIG. 3 illustrates the complete container clamping fixture, viewed in a plan view.

A complete container fixture is shown in plan view in FIG. 3. The fixture comprises a fork-shaped receiver 8, screw bolts 11 having magnetic heads 9, and set screw 10. At least one of these fixtures is arranged on the guide post 7 to be vertically movable. Screw bolts 11 can be quickly adjusted to any diameter of container 1 for fixing the latter precisely underneath universal flange 3. magnetic heads 9 firmly hold container 1 during the upward or downward movement of elevator table 2.

Figure 4:
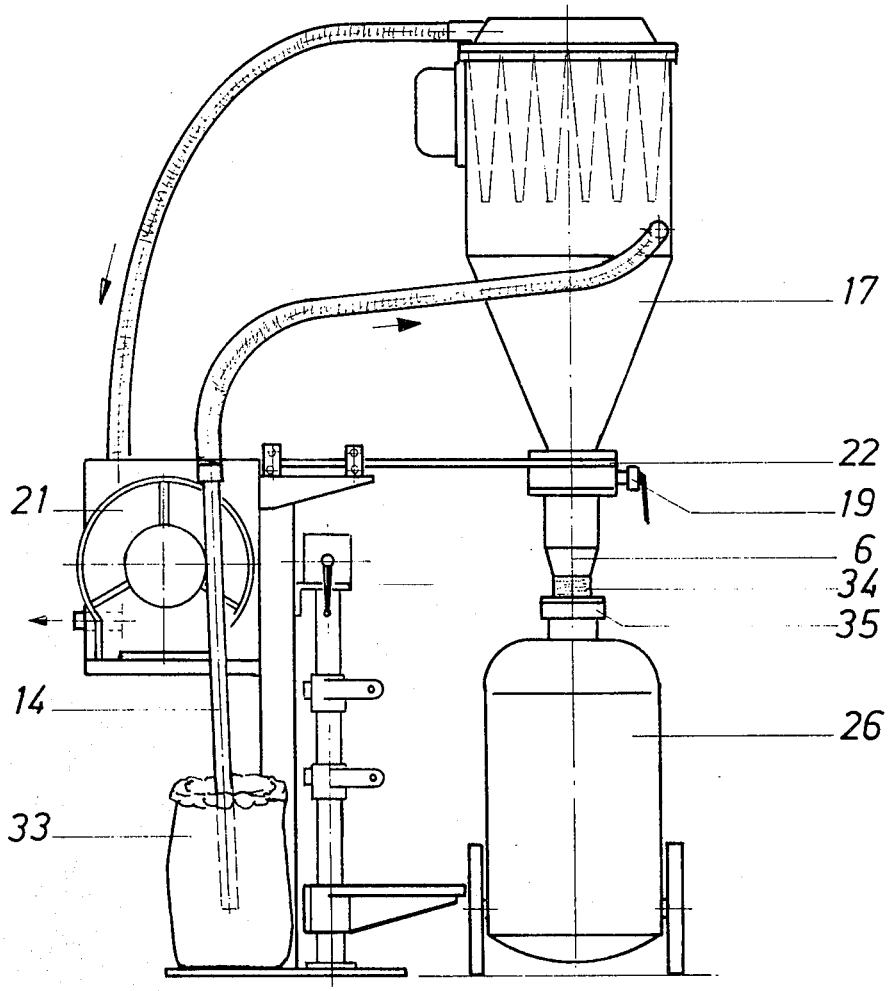
FIG. 4 shows a filling apparatus as shown in FIG. 1, with the sliding plate moved outwardly.

Another embodiment of the filling device is shown in FIG. 4, similar to the one shown in FIG. 1, but with the-sliding plate 22 moved away from post 7. This arrangement makes it possible to move the filling outlet durectly over the filling opening of a large container 26 to be filled.

The powder is sucked from the container in which it is supplied, in this case by the powder bag 33, as shown, and is conveyed in the same manner as it has been described above, by way of separator 17 and filling funnel 6 into container 26. The connection between the filling funnel 6 and container 26 is made airtight (gasproof) by means of the flexible intermediate adapter 34 and union nut 35.

Figure 5:
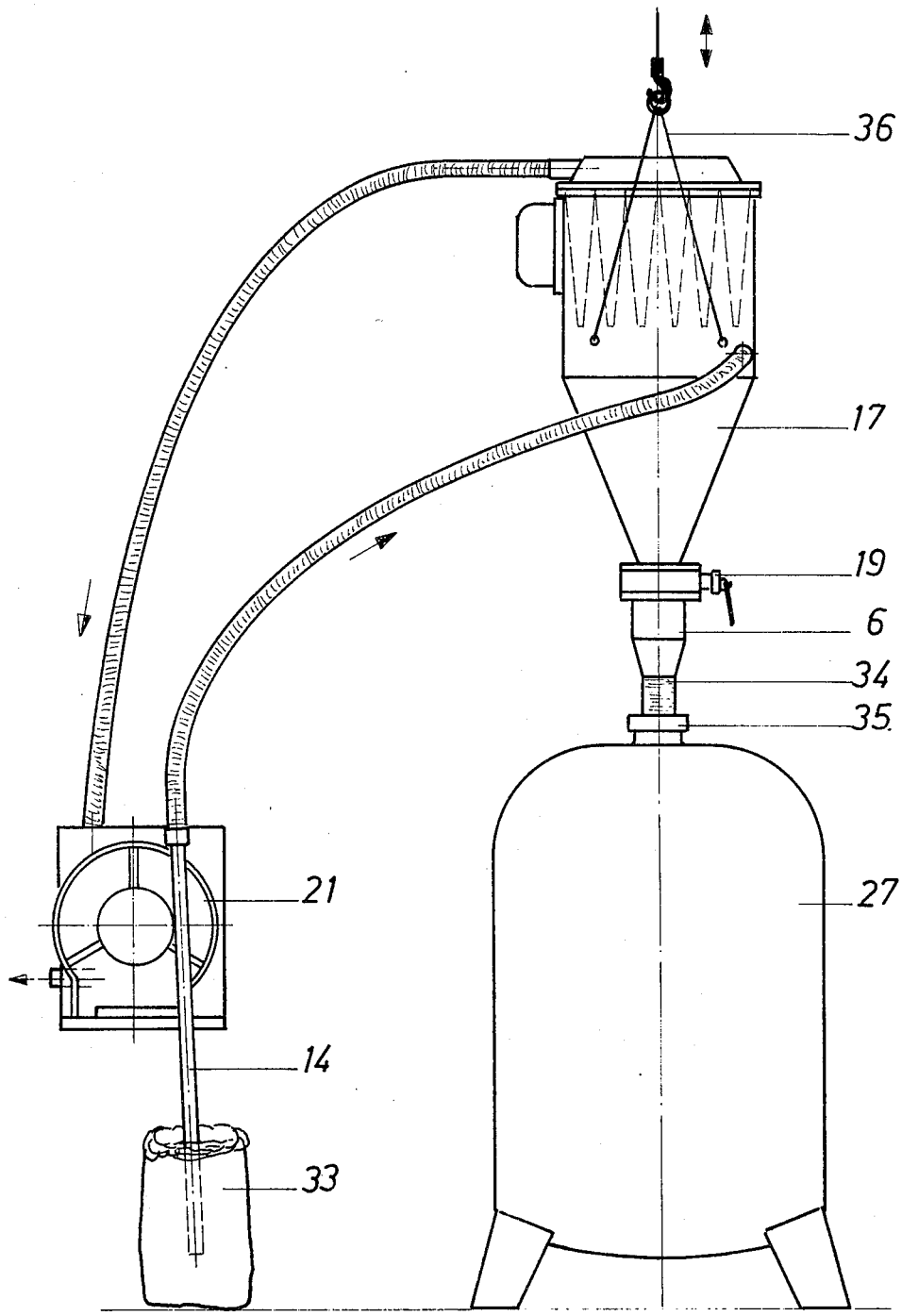
FIG. 5 shows another construction of the filling apparatus.

A further embodiment of the device of the invention is shown in FIG. 5, in which separator 17 with butterfly valve 19 and filling funnel 6 is fixed on a suspension fixture 36 and thus can be directly moved over the filling opening of the container 27 to be filled. In this location it is attached by way of flexible intermediate adapter 34 and union nut 35 to container 27, as shown in FIG. 4. Filling of container 27 is performed from bag 33 in which the powder is supplied, in the same manner as shown in FIG. 4.

Figure 6:
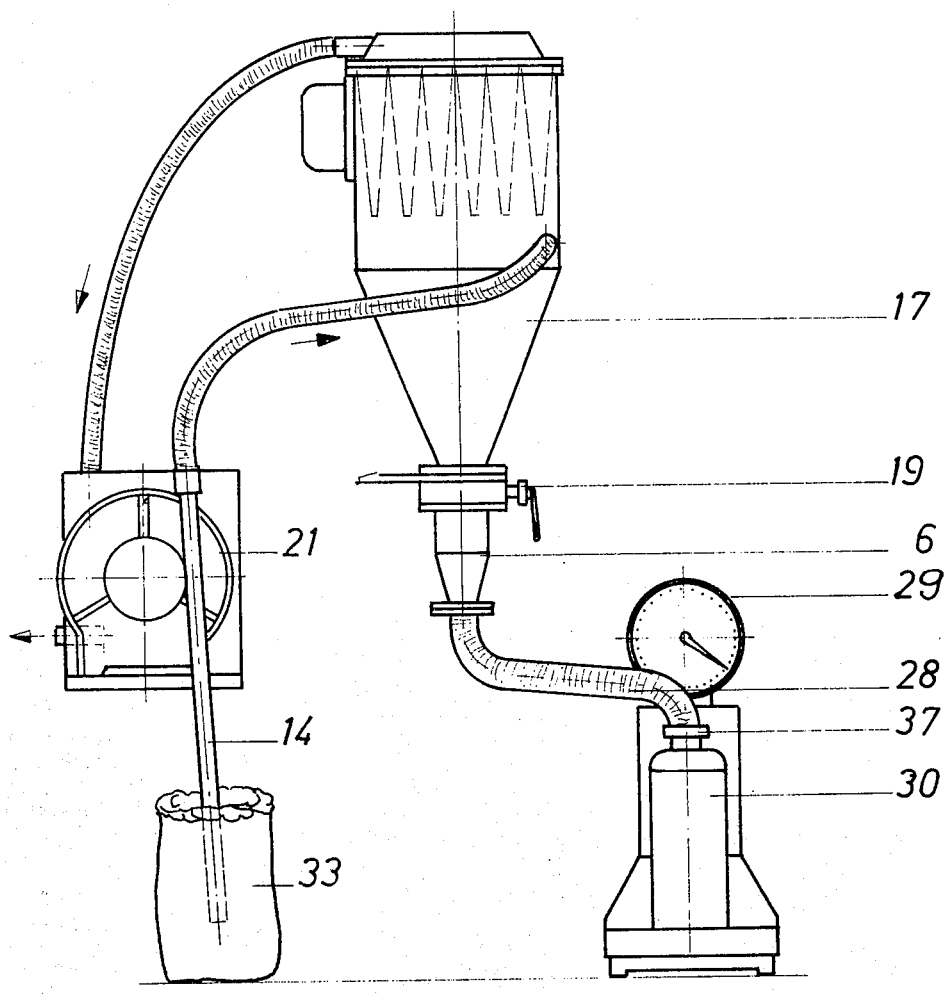
FIG. 6 shows the filling apparatus arranged for filling of a series of identical containers, combined wtih a weighing scale.

FIG. 6 illustrates a further use which is particularly desirable when an entire series of identical containers if to be filled and precise filling is required. To this extent a scale 29 is placed in front of the filling device, and the container 30 to be filled is placed on scale 29. Instead of universal flange 3, an elastic hose 28 is attached to filling funnel 6 and the connection between funnel 6 and container 30 is made dustproof by union nut 37.

In this embodiment the negative pressure which prevails in both separator 17 and container 30 must be prevented from exerting a negative influence on the accuracy of the weighing. Therefore, elastic hose 28 is almost horizontally arranged, or with only quite a slight incline, from filling funnel 6 to container 30. The weight of elastic hose 28 must be taken into consideration at the tare adjustment of scale 29.

A movable filling device is illustrated in FIG. 7, which can be carried in a truck 38. To this extent a swingable device 40 is attached to the support post 39, by which separator 17 can be swung downward by approximately 180°. Subsequently the entire device can be tilted on the tilting bearing 31 by 90° and then can be moved by means of the extendable rail 32 into the inner space of truck 38.

The construction of the device itself is the same as shown in FIG. 1, with the exception that suction apparatus 21 is permanently installed in the inner space of truck 38 and suction duct 25 is flexible enough so that it can follow the movements of separator 17.

FIG. 8 illustrates the filling device shown in FIG. 7 in the folded state. When separator 17 is swung down, a spring (not shown) in the swingable device 40 is tensioned which provides the necessary aid for erecting separator 17. The pivot point of tilting bearing 31 is arranged in such manner that the entire filling device can easily be tilted and be moved into truck 38.

The present invention is especially adapted to the emptying and filling of fire-extinguishers with the difficultly-flowable fire-extinguishing powder. Containers in the form of fire extinguishers are shown in FIG. 1, namely containers 1 and 13, FIG. 6, namely container 30, and FIGS. 7 and 8, namely container 13. It is understood that the apparatus of the other FIGS. may also be used to fill fire-extinguishers.

What is claimed is:

1. Apparatus for emptying and filling fire-extinguishers with difficultly-flowable fire-extinguishing powder, comprising separator means including a filter, a transparent funnel-shaped outlet means below said filter, and a dust-proof butterfly valve for controlling flow of powder through said outlet means; means for conveying said powder from a container containing the same to said separator means, including suction means for drawing air from the atmosphere and for conveying by suction an admixture of powder and air from said supply to said separator means below said filter, said suction means including conduit means connected to the separator means above said filter for causing by suction a flow of air upwardly through said filter and thence out of said separator means to the atmosphere; a universal flange on said outlet means for connecting said outlet means to the fire-extinguisher to be filled; clamping means for securely holding the container during removal of powder therefrom; an elevator table, support means on said table for holding a fire-extinguisher thereon during filling of said fire-extinguisher, said support means having a fork-shaped receiving fixture, movable bolts on said fixture, magnetic heads on said bolts for holding a fire extinguisher in place, and set-screw means for securing said bolts, and a crank drive for lifting the table until the fire-extinguisher thereon is sealed by said universal flange; said separator means being operable to filter powder from the admixture of powder and air flowing upwardly through the filter in the separator means and to allow the separated powder to fall into said funnel-shaped outlet means; and means for cleaning said filter and separator means, including means for flowing air downwardly through said filter and means for vibrating said filter and separator means.

2. Apparatus according to claim 1, wherein said suction means includes an inlet tube, with a quick-cleanable strainer arranged in said inlet tube to prevent passage of lumps into said separator means.

3. Apparatus according to claim 1, wherein said separator means is mounted on a plate for sliding movement horizontally, whereby the funnel-shaped outlet means may be moved directly over a fire extinguisher to be filled.

4. Apparatus according to claim 1, wherein said universal flange has a bore therein having an inside diameter for fitting over the smallest size of fire-extinguisher to be filled.

5. Apparatus according to claim 1, wherein an air-tight flexible connector surrounds said universal flange.

6. Apparatus according to claim 1, wherein said support means is a common guide post disposed for slidably accommodating said elevator table, said clamping means and said fork-shaped receiving fixtures.

7. Apparatus according to claim 1, wherein the separator means is pivotally mounted on a support means for pivotal movement downwardly about 180 degrees and spring means biasing said separator means against said downward movement.

8. Apparatus for emptying and filling fire-extinguishers with difficultly-flowable fire-extinguishing powder, comprising separator means including a filter, a transparent funnel-shaped outlet means below said filter, and a dust-proof butterfly valve for controlling flow of powder through said outlet means; means for conveying said powder from a supply thereof to said separator means, including suction means for drawing air from the atmosphere and for conveying by suction an admixture of powder and air from said supply to said separator means below said filter, said suction means including conduit means connected to the separator means above said filter for causing by suction a flow of air upwardly through said filter and thence out of said separator means to the atmosphere; means for connecting said outlet means to the fire-extinguisher to be filled; said separator means being operable to filter powder from the admixture of powder and air flowing upwardly through the filter in the separator means and to allow the separated powder to fall into said funnel-shaped outlet means; means for cleaning said filter and separator means, including means for flowing air downwardly through said filter and means for vibrating said filter and separator means; and means for pivotally mounting said separator means on a support means for pivotal movement downwardly about 180° and spring means biasing said separator means against said downward movement.

* * * * *